US012584668B2

(12) United States Patent
Li et al.

(10) Patent No.: US 12,584,668 B2
(45) Date of Patent: Mar. 24, 2026

(54) AIR CONDITIONING SYSTEM, REFRIGERANT STATE DETECTION METHOD AND COMPUTER-READABLE STORAGE MEDIUM

(71) Applicants: GD MIDEA HEATING & VENTILATING EQUIPMENT CO., LTD., Foshan (CN); MIDEA GROUP CO., LTD., Foshan (CN)

(72) Inventors: Zhongzhen Li, Foshan (CN); Bo Fan, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 390 days.

(21) Appl. No.: 18/260,608

(22) PCT Filed: Sep. 7, 2021

(86) PCT No.: PCT/CN2021/116969
§ 371 (c)(1),
(2) Date: Jul. 6, 2023

(87) PCT Pub. No.: WO2022/151747
PCT Pub. Date: Jul. 21, 2022

(65) Prior Publication Data

US 2024/0068722 A1 Feb. 29, 2024

(30) Foreign Application Priority Data

Jan. 15, 2021 (CN) ..... 202110055363.5

(51) Int. Cl.
*F25B 49/02* (2006.01)

(52) U.S. Cl.
CPC ..... *F25B 49/02* (2013.01); *F25B 2500/222* (2013.01); *F25B 2700/171* (2013.01);
(Continued)

(58) Field of Classification Search
CPC ..... F25B 2500/222; F25B 2700/171; F25B 2700/1931; F25B 2700/1933;
(Continued)

(56) References Cited

U.S. PATENT DOCUMENTS 7,392,659 B2 * 7/2008 Hong ..... F25B 49/022 62/115
8,590,325 B2 * 11/2013 Pham ..... F25B 49/005 62/126
(Continued)

FOREIGN PATENT DOCUMENTS

CN 101506600 A 8/2009
CN 103225866 A 7/2013
(Continued)

OTHER PUBLICATIONS

ISR mailed Dec. 16, 2021 for PCT/CN2021/116969.
(Continued)

*Primary Examiner* — Scott T Baderman
*Assistant Examiner* — Mario M Velez-Lopez
(74) *Attorney, Agent, or Firm* — K&L Gates LLP

(57) ABSTRACT

An air conditioning system, a refrigerant state detection method and a computer-readable storage medium. By adjusting first operating parameters of the air conditioning system, where the first operating parameters include a frequency of a compressor, a wind speed setting, and an opening degree of an electronic expansion valve; collecting second operating parameters of the air conditioning system at a preset time after the first operating parameters have been adjusted, where the second operating parameters include an
(Continued)

outdoor environment temperature and operating parameters of the compressor; and determining a refrigerant state of the air conditioning system according to the second operating parameters.

13 Claims, 10 Drawing Sheets

(52) U.S. Cl.
CPC ..... *F25B 2700/1931* (2013.01); *F25B 2700/1933* (2013.01); *F25B 2700/2103* (2013.01); *F25B 2700/2106* (2013.01); *F25B 2700/21151* (2013.01); *F25B 2700/21152* (2013.01)

(58) Field of Classification Search
CPC ..... F25B 2700/2103; F25B 2700/2106; F25B 2700/21151; F25B 2700/21152; F25B 49/02
See application file for complete search history.

(56) References Cited

U.S. PATENT DOCUMENTS

| | | | | |
|---|---|---|---|---|
| 2014/0060105 | A1* | 3/2014 | Azuma | F24F 3/065 62/324.1 |
| 2015/0247660 | A1* | 9/2015 | Nakajima | F24F 11/30 62/225 |
| 2016/0146521 | A1* | 5/2016 | Tomita | F25B 49/022 62/190 |
| 2016/0363354 | A1* | 12/2016 | Ito | F25B 39/00 |
| 2020/0200457 | A1* | 6/2020 | Sata | F25B 49/02 |

FOREIGN PATENT DOCUMENTS

| | | | | | |
|---|---|---|---|---|---|
| CN | 103344357 | A | | 10/2013 | |
| CN | 103574835 | A | | 2/2014 | |
| CN | 105485992 | A | | 4/2016 | |
| CN | 105509242 | A | | 4/2016 | |
| CN | 105928059 | A | | 9/2016 | |
| CN | 106440587 | A | | 2/2017 | |
| CN | 106545973 | A | | 3/2017 | |
| CN | 106642555 | A | | 5/2017 | |
| CN | 107642879 | A | | 1/2018 | |
| CN | 107917512 | A | | 4/2018 | |
| CN | 108375170 | A | | 8/2018 | |
| CN | 108759007 | A | | 11/2018 | |
| CN | 109798627 | A | | 5/2019 | |
| CN | 110579039 | A | | 12/2019 | |
| CN | 110940059 | A | | 3/2020 | |
| CN | 111059709 | A | | 4/2020 | |
| CN | 112033040 | A | | 12/2020 | |
| JP | 04283362 | A | | 10/1992 | |
| JP | 2007198642 | A | * | 8/2007 | F25B 45/00 |
| JP | 6387276 | B2 | * | 9/2018 | |
| KR | 19990024533 | A | | 4/1999 | |
| WO | 2009093297 | A1 | | 7/2009 | |
| WO | 2017013757 | A1 | | 1/2017 | |

OTHER PUBLICATIONS

First OA malled Dec. 16, 2021 for Invention CN Application No. 202110055363.5.
Grant of Notice of Patent Right mailed Apr. 26, 2022 for Invention CN Application No. 202110055363.5.
Extended European search report received in EP Application No. 21918938.8; mailed May 31, 2024.

* cited by examiner

AIR CONDITIONING SYSTEM, REFRIGERANT STATE DETECTION METHOD AND COMPUTER-READABLE STORAGE MEDIUM

CROSS-REFERENCES TO RELATED APPLICATIONS

The present disclosure is a national phase application of International Application No. PCT/CN2021/116969, filed on Sep. 7, 2021, which claims the benefit of Chinese Patent Application No. 202110055363.5, filed with China National Intellectual Property Administration on Jan. 15, 2021, the entireties of which are herein incorporated by reference.

FIELD

The present disclosure relates to the field of air conditioning, and more particularly, relates to an air conditioning system, a refrigerant state detection method and a computer-readable storage medium.

BACKGROUND

With continuous development of the air-conditioning technology and the promotion of application of air conditioners, air conditioners are more and more popular in people's daily production and work and life, and people are putting more and more emphasis on the safety requirements of air conditioners, including the detection of refrigerant leakage. The refrigerant state of an air conditioning system is difficult to determine due to the complex installation conditions of the air conditioning system, the variability of operating conditions and use conditions. in some embodiments. the refrigerant state determination for determination of the operation state of the air conditioning system and is also a basis for determination of refrigerant leakage.

SUMMARY

The embodiments of the present disclosure provides a refrigerant state detection method, including:

adjusting first operating parameters of an air conditioning system, where the first operating parameters include a frequency of a compressor, a wind speed setting, and an opening degree of an electronic expansion valve;

collecting second operating parameters of the air conditioning system at a preset time after the first operating parameters have been adjusted, where the second operating parameters include an outdoor environment temperature and operating parameters of the compressor;

determining a refrigerant state of the air conditioning system according to the second operating parameters.

The embodiments of the present disclosure provides an air conditioning system, including a memory, a processor and a computer program stored in the memory and executable on the processor, the processor performs operations of the refrigerant state detection method according to the embodiments of the present disclosure when executing the computer program.

The embodiments of the present disclosure provides a computer-readable storage medium storing a computer program, which, when executed by a processor of an air conditioning system, causes the processor to perform operations of the refrigerant state detection method according to the embodiments of the present disclosure.

BRIEF DESCRIPTION OF THE DRAWINGS

To more clearly illustrate the embodiments of the disclosure, the figures to be referenced in the description of the embodiments or prior art will be briefly described in the following. Apparently, the described figures are some of the embodiments of the present disclosure.

DETAILED DESCRIPTION OF THE DISCLOSURE

Figure 1:
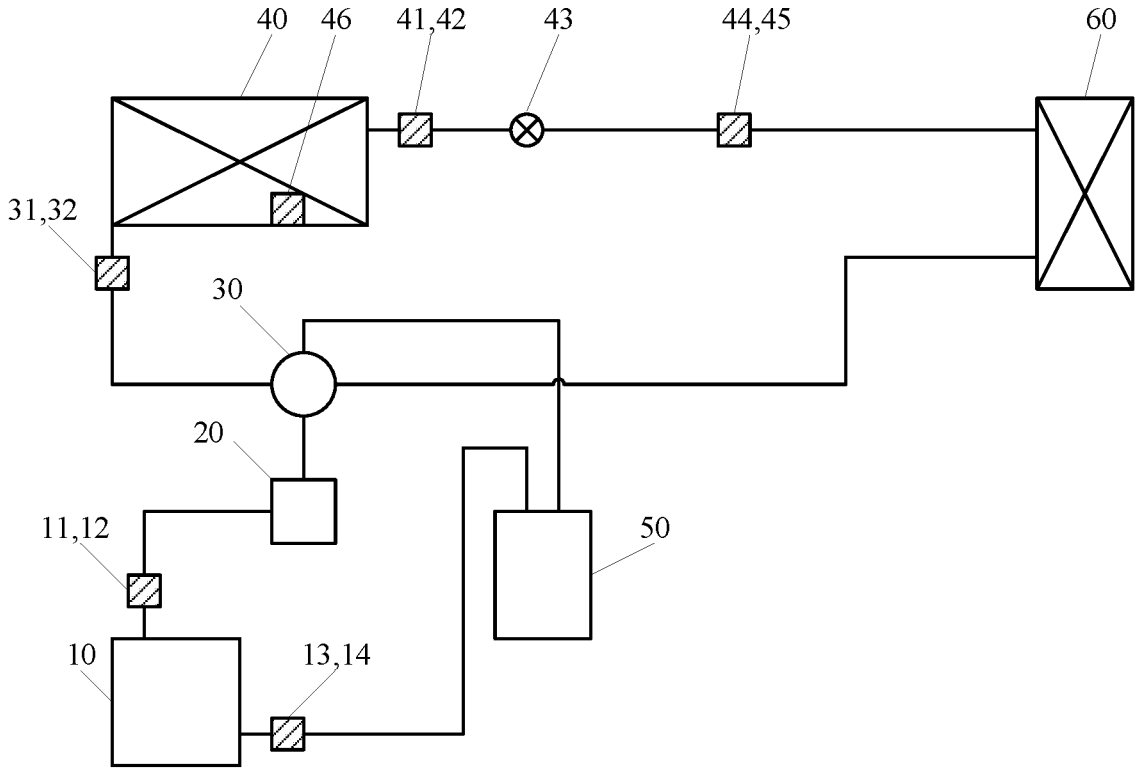
FIG. 1 is a schematic diagram of a first structure of an air conditioning system provided in the embodiments of this disclosure.

In the following descriptions, for purposes of explanation instead of limitation, specific system architectures, details, and the like are set forth in order to provide a thorough understanding of the embodiments of the present disclosure. In other instances, detailed descriptions of well-known systems, apparatuses, circuits, and methods are omitted and not to obscure the description of the present disclosure with unnecessary details.

It will be understood that the terms "comprises" when used in the description of this disclosure and the appended claims, specifies the presence of stated features, integers, steps, operations, elements, and/or components, but does not preclude the presence or addition of one or more other features, integers, steps, operations, elements, components, and/or groups thereof.

It will also be understood that the term "and/or" as used in the description of the disclosure and the appended claims refers to and encompasses any and all possible combinations of one or more of the associated listed items.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

In addition, in the descriptions of this disclosure and the appended claims, the terms "first", "second", "third", and the like are merely intended for a purpose of differentiated description, but shall not be understood as an indication or an implication of relative importance.

The referenced "one embodiment" or "some embodiments" throughout the description of this disclosure means that one or more embodiments of the present disclosure include particular features, structures, or characteristics described in combination with the embodiment(s). Thus, the statements "in one embodiment", "in some embodiments", "in other embodiments", "in further embodiments" and the like appearing at different places in this description are not necessarily referring to the same embodiment(s), but rather mean "one or more but not all embodiments" unless otherwise specifically emphasized. The terms "including", "comprising", "having" and variations thereof mean "including, but not limited to", unless otherwise specifically emphasized.

The embodiments of this disclosure provide a refrigerant state detection method, which may be executed by a processor of an air conditioning system when running a corresponding computer program. The air conditioning system may be a stand-alone air conditioning system, or may be a multi-unit air conditioning system. The stand-alone air conditioning system and the multi-unit air conditioning system may be cooling-only systems for cooling only.

In practice, an air conditioning system may include, but is not limited to, a memory, a processor, and a compressor, a heat exchanger, an electronic expansion valve, a pressure sensor, a temperature sensor, etc. which are connected to the processor, and may further include an oil separator, a four-way valve, a gas-liquid separator, an economizer, an evaporator, and pipelines connecting the components, and the like.

The air conditioning system described in the embodiments of this disclosure does not constitute a limitation on the air conditioning system, and the air conditioning system may include more or fewer components, or some components, or different component arrangements.

As shown in FIG. 1, a schematic diagram of a structural of an air conditioning system that does not include an economizer is shown as an example, in which the air conditioning system includes a compressor 10, an oil separator 20, a four-way valve 30, a heat exchanger 40, a gas-liquid separator 50, and an evaporator 60;

In which the compressor 10 and the oil separator 20 are connected through an exhaust pipe therebetween, which is provided with an exhaust pressure sensor 11 and an exhaust temperature sensor 12; the compressor 10 and the gas-liquid separator 50 are connected through a first return pipe therebetween, which is provided with a return pressure sensor 13 and a return temperature sensor 14;

The oil separator 20 and the four-way valve 30 are connected through a high-pressure air pipe;

The four-way valve 30 and the heat exchanger 40 are connected through a condenser pipe therebetween, which is provided with a heat exchanger inlet pressure sensor 31 and a heat exchanger inlet temperature sensor 32; the four-way valve 30 and the gas-liquid separator 50 are connected through a second return pipe therebetween, and the four-way valve 30 and the evaporator 60 are connected through a low-pressure air pipe therebetween;

The heat exchanger 40 and the evaporator 60 are connected through a high-pressure liquid pipe therebetween, which is provided with a heat exchanger outlet pressure sensor 41, a heat exchanger outlet temperature sensor 42, a first electronic expansion valve 43, a high-pressure liquid pipe outlet pressure sensor 44 and a high-pressure liquid pipe outlet temperature sensor 45; the heat exchanger 40 is provided with an outdoor environment temperature sensor 46.

Figure 2:
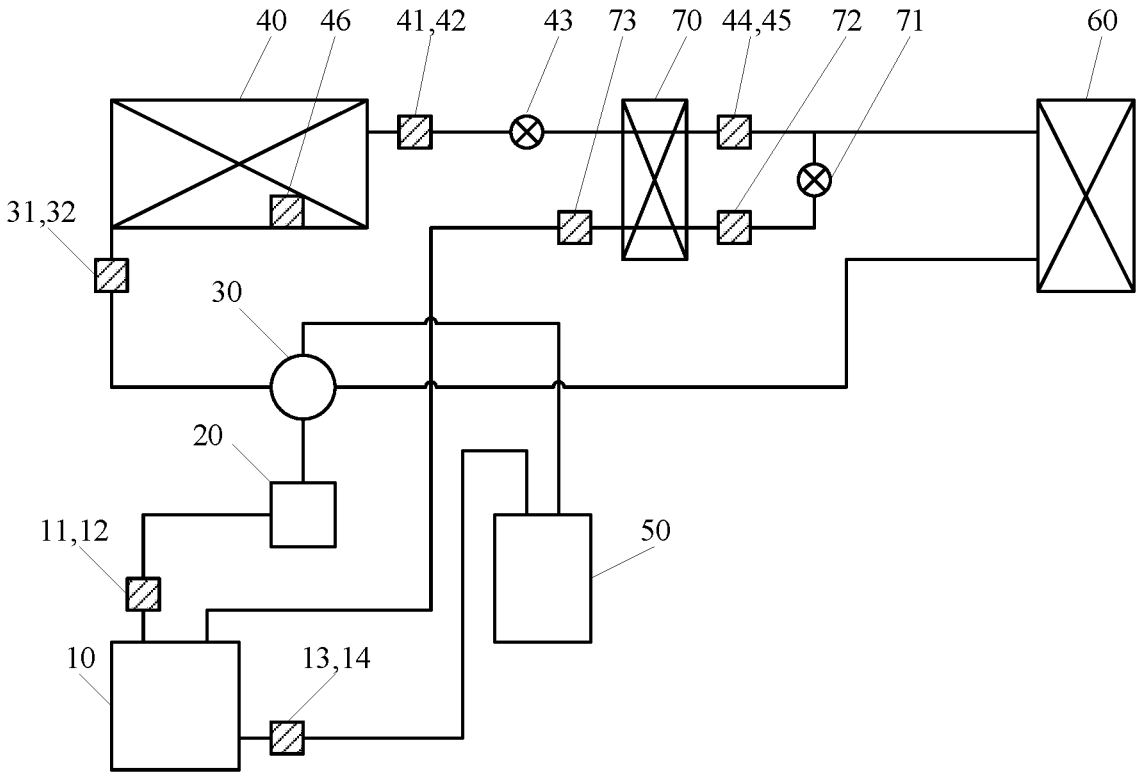
FIG. 2 is a schematic diagram of a second structure of an air conditioning system provided in the embodiments of this disclosure.

As shown in FIG. 2, a schematic diagram of a structural of an air conditioning system that includes an economizer is shown as an example, in which the air conditioning system further includes an economizer 70 in addition to those shown in FIG. 1. An inlet of the economizer 70 is connected to the high-pressure liquid pipe 41 through an input pipe, which is provided with a second electronic expansion valve 71 and an economizer inlet temperature sensor 72. An outlet of the economizer 70 is connected to the compressor 10 through an output pipe, which is provided with an economizer outlet temperature sensor 73.

Figure 3:
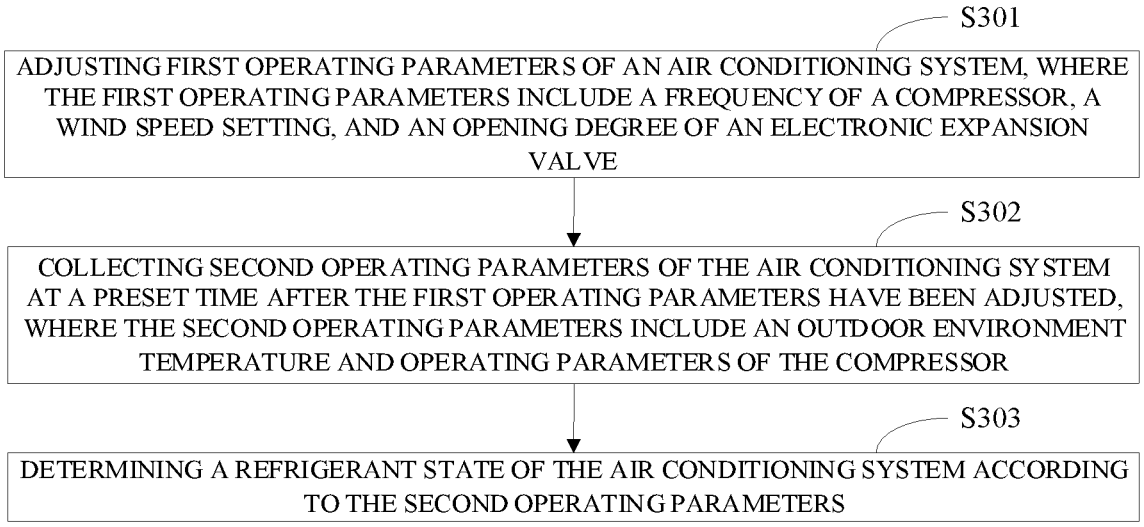
FIG. 3 is a schematic diagram of a first process of a refrigerant state detection method provided in the embodiments of this disclosure.

As shown in FIG. 3, the refrigerant state detection method for an air conditioning system provided in the embodiments of this disclosure includes the following steps S301 to S303:

At step S301, adjust first operating parameters of the air conditioning system, where the first operating parameters include a frequency of the compressor, a wind speed setting, and an opening degree of the electronic expansion valve.

In practice, the refrigerant state detection may be immediately and automatically performed after the air conditioning system is powered on, or may be performed automatically at any time when a user needs to after the air conditioning system is powered on. For example, the air conditioning system may be powered on when receiving a starting instruction sent by the user and adjust the first operating parameters of the air conditioning system to specified values; and may also adjust the first operating parameters of the air conditioning system to the specified values when receiving the refrigerant state detection instruction sent by the user after the air conditioning system is power on. The first operating parameters include the frequency of the compressor of the outdoor unit of the air conditioning system, the wind speed setting of the outdoor unit, and the opening degree of the electronic expansion valve of the outdoor unit. In case where the air conditioning system does not include an economizer, the electronic expansion valve may be the electronic expansion valve of the outdoor unit, for example, the first electronic expansion valve 43 shown in FIG. 1; in case where the air conditioning system includes an economizer, the electronic expansion valves may include both the electronic expansion valve of the outdoor unit and an electronic expansion valve of the economizer, for example, the first electronic expansion valve 43 and the second electronic expansion valve 71 shown in FIG. 2.

At step S302, collect second operating parameters of the air conditioning system at a preset time after the first operating parameters have been adjusted, where the second operating parameters include an outdoor environment temperature and operating parameters of the compressor.

At step S303, determine a refrigerant state of the air conditioning system according to the second operating parameters.

In practice, the second operating parameters of the air conditioning system may be collected at the preset time after the first operating parameters have been adjusted to enable the air conditioning system to stably operate in the refrigerant state detection mode, and the refrigerant state of the air conditioning system may be determined according to the second operating parameters. The preset time may be customized by the user according to actual needs or use a value from the factory default settings, as long as the air conditioning system may stably operate after entering the refrigerant state detection mode for the preset time.

In practice, the outdoor environment temperature is the temperature of the outdoor environment where the outdoor unit is located, and may be detected by a temperature sensor positioned outdoors, for example, the outdoor environment temperature sensor 47 shown in FIG. 1 or FIG. 2. The operating parameters of the compressor may include, but are not limited to, the frequency of the compressor, an exhaust pressure, a return pressure, a return temperature, an exhaust temperature, and the like. The exhaust pressure, the return pressure, the return temperature, and the exhaust temperature of the compressor may be detected by respective pressure sensors and temperature sensors, such as the exhaust pressure sensor 12, the return pressure sensor 15, the return temperature sensor 16, and the exhaust temperature sensor 13 shown in FIG. 1 or FIG. 2. In case where the air conditioning system does not include an economizer, the second operating parameters may further include a wind speed setting of the outdoor unit, an opening degree of the first electronic expansion valve, etc. In case where the air conditioning system includes an economizer, the second operating parameters may further include a wind speed setting of the outdoor unit, an economizer inlet temperature and an economizer outlet temperature, etc. The economizer inlet and outlet temperatures may be detected by a respective temperature sensor, for example, the economizer inlet temperature sensor 72 and economizer outlet temperature sensor 73 shown in FIG. 2.

Figure 4:
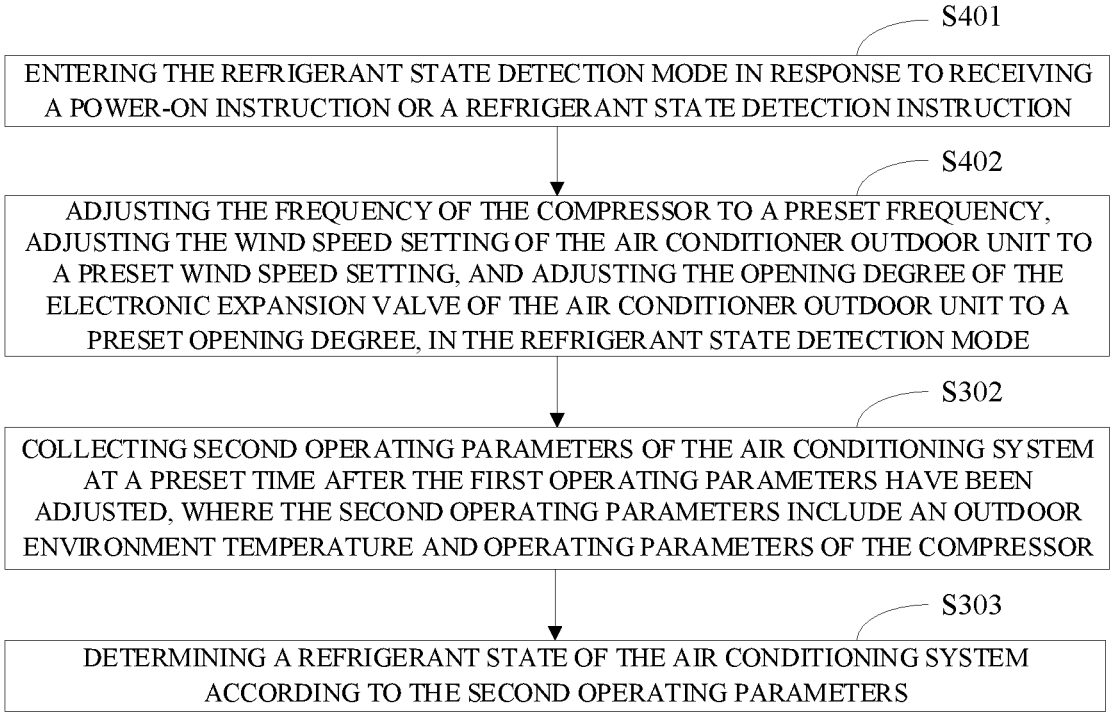
FIG. 4 is a schematic diagram of a second process of a refrigerant state detection method provided in the embodiments of this disclosure.

As shown in FIG. 4, in some embodiments, step S301 includes the following steps S401 and S402:

At step S401, enter the refrigerant state detection mode in response to receiving a power-on instruction or a refrigerant state detection instruction;

At step S402, adjust the frequency of the compressor to a preset frequency, adjust the wind speed setting of the air conditioner outdoor unit to a preset wind speed setting, and adjust the opening degree of the electronic expansion valve of the air conditioner outdoor unit to a preset opening degree in the refrigerant state detection mode.

In practice, the user may input the power-on instruction or the refrigerant state detection instruction through a human-computer interaction device of the air conditioning system according to actual needs, or send the power-on instruction or the refrigerant state detection instruction to the air conditioning system through a terminal device in communication connection with the air conditioning system, to control the air conditioning system to enter the refrigerant state detection mode. The human-computer interaction device of the air conditioning system may include at least one of a physical button, a touch sensor, a gesture recognition sensor and a speech recognition unit, so that the user may input the instruction with a corresponding touch control, gesture control, or a speech control.

In practice, the physical button and the touch sensor may be provided at any position of the air conditioning system, for example, at a control panel. The touch control of the physical button may be specifically by pressing or toggling. The touch control of the touch sensor may be specifically by pressing or touching, etc.

In practice, the gesture recognition sensor may be provided at any position of the air conditioning system, for example, outside the housing near the vent. The gesture for controlling the air conditioning system may be customized by the user according to actual needs or use a gesture from the factory default settings.

In practice, the speech recognition unit may include a microphone and a speech recognition chip, or may only include a microphone and a processor of the air conditioning system may implement speech recognition. The speech used to control the air conditioner may be customized by the user according to actual needs or may use a speech from the factory default settings.

In practice, the terminal device may be a mobile phone, a smart wristband, a tablet computer, a notebook computer, a netbook, a personal digital assistant (PDA), etc. which have a wireless communication function and may be in wireless communication connection with the air conditioning system. The embodiments of the disclosure provide no limitation on the specific type of the terminal device. The user may control, by means of any human-computer interaction supported by the terminal device, the terminal device to send an instruction to the air conditioning system. The human-computer interaction supported by the terminal device may be the same as the air conditioning system, and details are not described herein again.

In practice, the preset frequency, the preset wind speed setting, and the preset opening degree may be customized by the user according to actual needs or use those from the factory default settings, as long as the air conditioning system may gradually tend to be stable after entering the refrigerant state detection mode.

Figure 5:
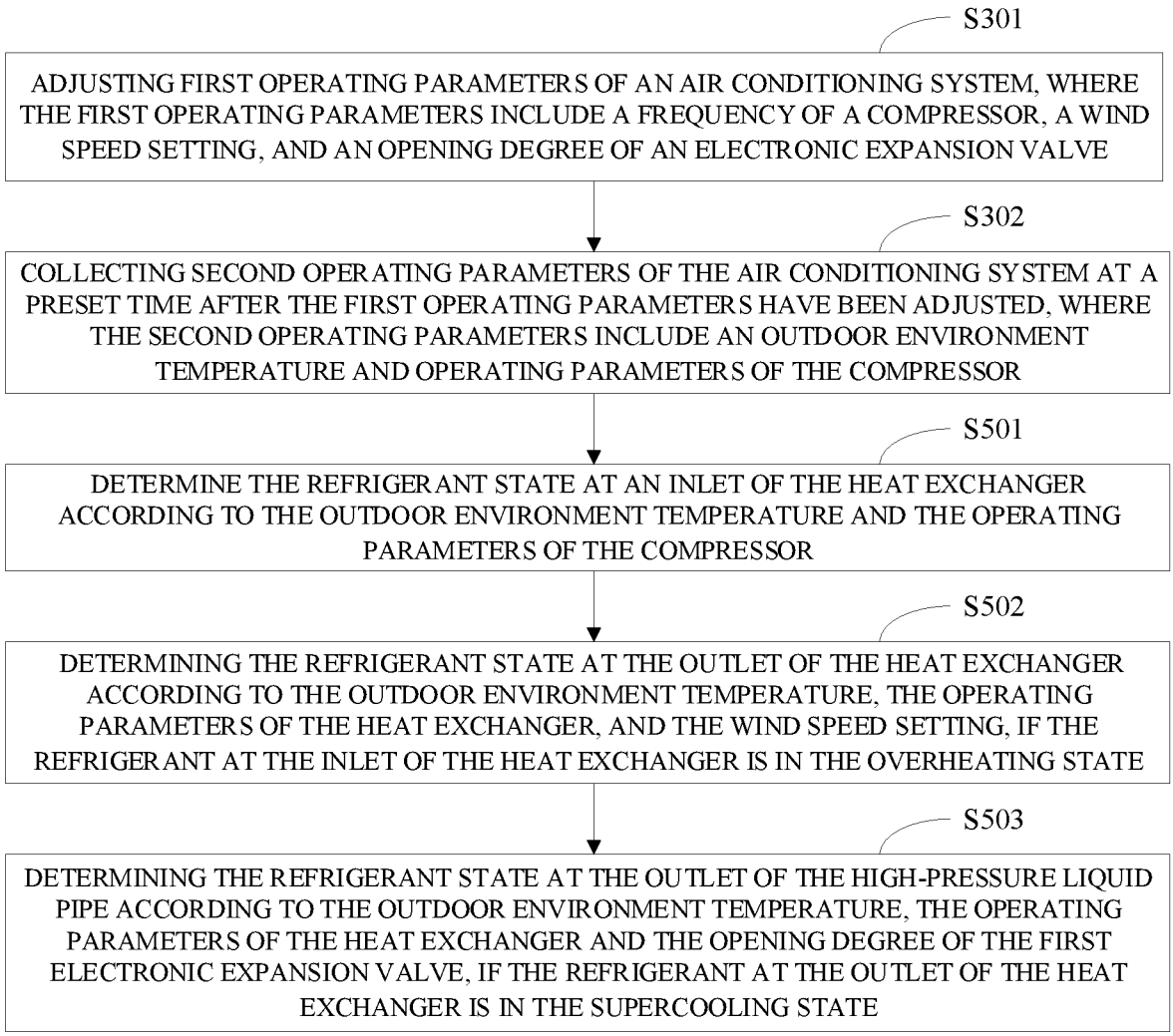
FIG. 5 is a schematic diagram of a third process of a refrigerant state detection method provided in the embodiments of this disclosure.

As shown in FIG. 5, in some embodiments, step S303 includes:

At step S501, determine the refrigerant state at an inlet of the heat exchanger according to the outdoor environment temperature and the operating parameters of the compressor.

In practice, the refrigerant state at the inlet of the heat exchanger may be determined according to the outdoor environment temperature and the operating parameters of the compressor. In one embodiment, it is possible to calculate the heat exchanger inlet temperature and a saturation temperature corresponding to the heat exchanger inlet pressure according to the outdoor environment temperature and the frequency, the exhaust pressure, the return pressure, the return temperature and the exhaust temperature of the compressor, and then determine the refrigerant state at the inlet of the heat exchanger according to the heat exchanger inlet temperature and the saturation temperature corresponding to the heat exchanger inlet pressure.

Figure 6:
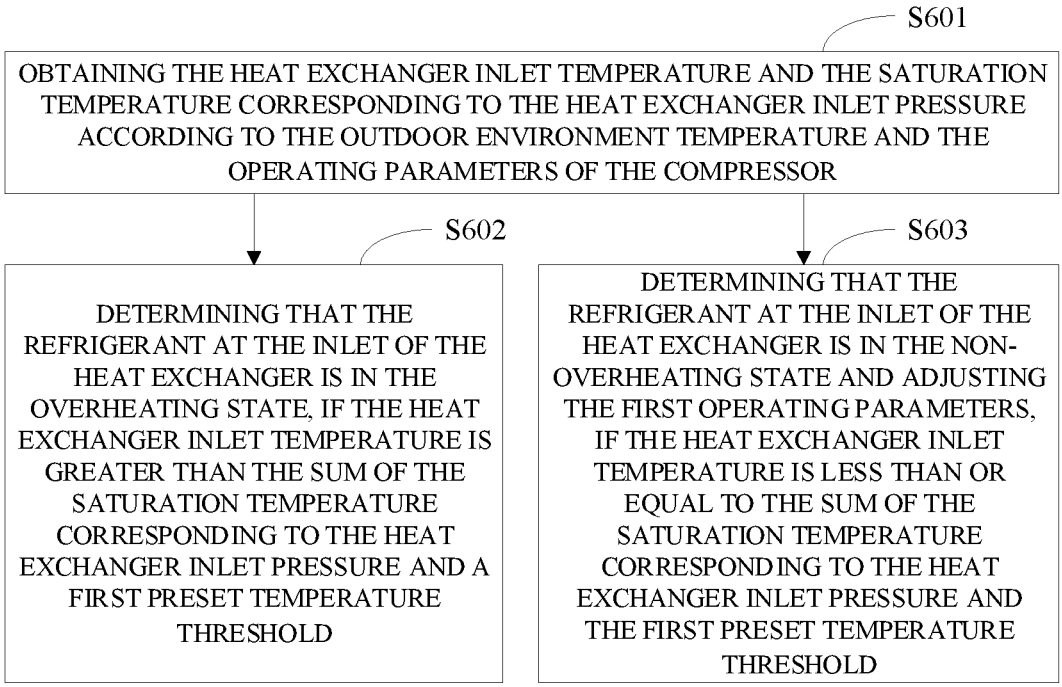
FIG. 6 is a schematic diagram of a fourth process of a refrigerant state detection method provided in the embodiments of this disclosure.

As shown in FIG. 6, in some embodiments, step S501 includes the following steps S601 to S603:

At step S601: obtain the heat exchanger inlet temperature and the saturation temperature corresponding to the heat exchanger inlet pressure according to the outdoor environment temperature and the operating parameters of the compressor;

At step S602: if the heat exchanger inlet temperature is greater than the sum of the saturation temperature corresponding to the heat exchanger inlet pressure and a first preset temperature threshold, then determine that the refrigerant at the inlet of the heat exchanger is in an overheating state;

At step S603, if the heat exchanger inlet temperature is less than or equal to the sum of the saturation temperature corresponding to the heat exchanger inlet pressure and the first preset temperature threshold, then determine that the refrigerant at the inlet of the heat exchanger is in a non-overheating state, and adjust the first operating parameters.

In practice, after the heat exchanger inlet temperature and the saturation temperature corresponding to the heat exchanger inlet pressure have been calculated, it is possible to compare the heat exchanger inlet temperature with the sum of the saturation temperature corresponding to the heat exchanger inlet pressure and the first preset temperature thresholds, and then determine the refrigerant state at the inlet of the heat exchanger according to the comparison result. If the refrigerant at the inlet of the heat exchanger is in the overheating state, then proceed to the next step, to continue to detect the refrigerant state at the outlet of the heat exchanger. If the refrigerant at the inlet of the heat exchanger is in the non-overheating state, then return to step S301, to continue to adjust the first operating parameters. The first preset temperature threshold may be customized by the user according to actual needs or use a value from the factory default settings, for example, any value between 1° C. and 3° C.

In some embodiments, step S601 includes the following steps:

- obtaining a refrigerant flow according to the frequency, the exhaust pressure, the return pressure and the return temperature of the compressor;
- obtaining a pressure drop of an exhaust pipeline of the compressor according to the exhaust temperature and the exhaust pressure of the compressor and the refrigerant flow;
- obtaining a heat leakage of the exhaust pipeline of the compressor according to the outdoor environment temperature, the exhaust temperature of the compressor, and the refrigerant flow;
- obtaining the heat exchanger inlet pressure according to the exhaust pressure of the compressor and the pressure drop of the exhaust pipeline;
- obtaining the heat exchanger inlet temperature according to the exhaust temperature of the compressor, the refrigerant flow, and the heat leakage of the exhaust pipeline;
- obtaining the saturation temperature corresponding to the heat exchanger inlet pressure according to the heat exchanger inlet pressure.

In practice, firstly a saturation temperature corresponding to the exhaust pressure of the compressor, that is, the condensation temperature, is calculated according to the exhaust pressure of the compressor, and a saturation temperature corresponding to the return pressure of the compressor, that is, the evaporation temperature, is calculated according to the return pressure of the compressor; and then the refrigerant flow is calculated according to the 10 coefficients of the compressor flow related to the frequency, the exhaust pressure, the return pressure and the return temperature of the compressor, the condensation temperature and the evaporation temperature.

In an embodiment, the calculation formulas of the refrigerant flow are as follows:

$$m=k1+k2*Te+k3*Tc+k4*Te\hat{}2+k5*Te*Tc+K6*Tc\hat{}2+k7*Te\hat{}3+k8*Te\hat{}2*Tc+k9*Te*Tc\hat{}2+k1\ 0*Tc\hat{}3$$

$$Te=b1/(\ln(ps)-b2)-b3$$

$$Tc=b1/(\ln(pd)-b2)-b3$$

The calculation formula of the pressure drop of the exhaust pipeline of the compressor is as follows:

$$dp1=f1(m,Td,pd)=A1*m*\exp(B1*Tc)*(Td-Tc)$$

The calculation formula of the heat leakage of the exhaust pipeline of the compressor is as follows:

$$Q1=f2(m,Td,T0)=(Td-T0)*A2*m$$

The calculation formula of the heat exchanger inlet pressure is as follows:

$$p1=pd-dp1$$

The calculation formula of the heat exchanger inlet temperature is as follows:

$$T1=Td-Q1/(m*B2*Tds)$$

The calculation formula of the saturation temperature corresponding to the heat exchanger inlet pressure is as follows:

$$T1s=b1/(\ln(p1)-b2)-b3$$

where m is the refrigerant flow, k1~k10 are the ten coefficients related to the frequency, the exhaust pressure pd, the return pressure ps and the return temperature Ts of the compressor, Te is the saturation temperature corresponding to the return pressure of the compressor, Tc is the saturation temperature corresponding to the exhaust pressure pd of the compressor, and B1~B2 and b1~b3 are refrigerant physical parameters related to the refrigerant type;

dp1 is the pressure drop of the exhaust pipeline of the compressor, f1(m, Td, pd) is a function related to the exhaust temperature Td and the exhaust pressure pd of the compressor and the refrigerant flow m, and A1~A2 are parameters related to the structure of the exhaust pipeline;

Q1 is the heat leakage of the exhaust pipeline of the compressor, and f2(m, Td, TO) is a function related to the outdoor environment temperature TO, the exhaust temperature Td of the compressor, and the refrigerant flow m;

p1 is the heat exchanger inlet pressure;

T1 is the heat exchanger inlet temperature;

T1s is the saturation temperature corresponding to the heat exchanger inlet pressure;

* is a multiplication operator, ^ is a exponentiation operator, / is an division operator, ln ( ) is a logarithmic function.

As shown in FIG. 5, in some embodiments, step S303 further includes:

Step S502, determining the refrigerant state at the outlet of the heat exchanger according to the outdoor environment temperature, the operating parameters of the heat exchanger, and the wind speed setting, if the refrigerant at the inlet of the heat exchanger is in an overheating state.

In practice, if the refrigerant at the inlet of the heat exchanger is in the overheating state, then it is possible to further determine the refrigerant state at the outlet of the heat exchanger according to the outdoor environment temperature, the operating parameters of the heat exchanger, and the wind speed setting. The operating parameters of the heat exchanger may include, but are not limited to, an inlet pressure, an outlet pressure, an inlet temperature and an outlet temperature of the heat exchanger, and the like. The inlet pressure, the outlet pressure, the inlet temperature and the outlet temperature of the heat exchanger may be detected by respective pressure sensors and temperature sensors, such as the heat exchanger inlet pressure sensor 31, the heat exchanger outlet pressure sensor 41, the heat exchanger inlet temperature sensor 32, and the heat exchanger outlet temperature sensor 42 shown in FIG. 1 or FIG. 2. In one embodiment, it is possible to calculate the heat exchanger outlet temperature and a saturation temperature corresponding to the heat exchanger outlet pressure according to the outdoor environment temperature, the refrigerant flow, the heat exchanger inlet pressure and inlet temperature, the saturation temperature corresponding to the heat exchanger inlet pressure and the wind speed setting, and then determine the refrigerant state at the outlet of the heat exchanger according to the heat exchanger outlet temperature and the saturation temperature corresponding to the heat exchanger outlet pressure.

Figure 7:
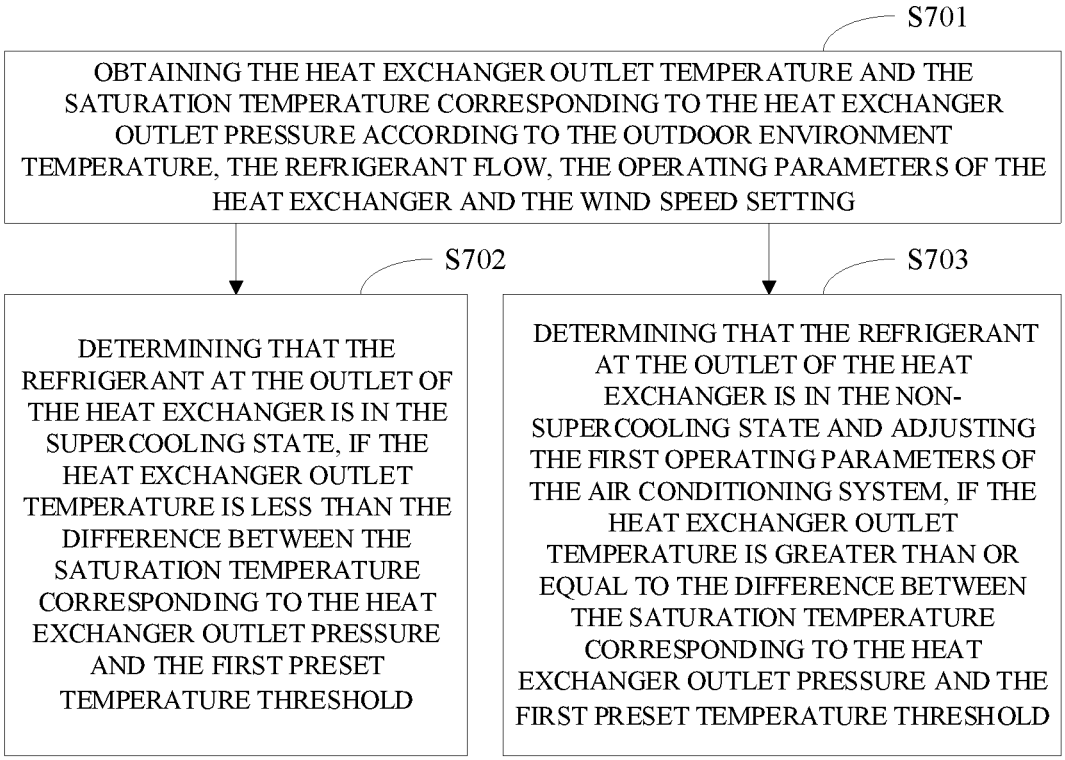
FIG. 7 is a schematic diagram of a fifth process of a refrigerant state detection method provided in the embodiments of this disclosure.

As shown in FIG. 7, in some embodiments, step S502 includes the following steps S701 to S703:

At step S701, obtain the heat exchanger outlet temperature and the saturation temperature corresponding to the heat exchanger outlet pressure according to the outdoor environment temperature, the refrigerant flow, the operating parameters of the heat exchanger and the wind speed setting;

At step S702, if the heat exchanger outlet temperature is less than a difference between the saturation temperature corresponding to the heat exchanger outlet pressure and the first preset temperature threshold, then determine that the refrigerant at the outlet of the heat exchanger is in a supercooling state.

At step S703, if the heat exchanger outlet temperature is greater than or equal to the difference between the saturation temperature corresponding to the heat exchanger outlet pressure and the first preset temperature threshold, then determine that the refrigerant at the outlet of the heat exchanger is in a non-supercooling state, and adjust the first operating parameters of the air conditioning system.

In practice, after the heat exchanger outlet temperature and the saturation temperature corresponding to the heat exchanger outlet pressure have been calculated, it is possible to compare the heat exchanger outlet temperature with the difference between the saturation temperature corresponding to the heat exchanger outlet pressure and the first preset temperature threshold, then determine the refrigerant state at the outlet of the heat exchanger according to the comparison result. If the refrigerant at the outlet of the heat exchanger is in the supercooling state, then proceed to the next step, to continue to detect the refrigerant state at the outlet of the high-pressure liquid pipe. If the refrigerant at the inlet of the heat exchanger is in the non-supercooling state, then return to step S301, to continue to adjust the first operating parameters.

In some embodiments, step S701 includes the following steps:

- obtaining a refrigerant pressure drop of the heat exchanger according to the wind speed setting and the refrigerant flow;
- obtaining a heat exchange of the heat exchanger according to the outdoor environment temperature, the wind speed setting, the refrigerant flow, and the heat exchanger inlet pressure and the inlet temperature;
- obtaining the heat exchanger outlet pressure according to the heat exchanger inlet pressure and the refrigerant pressure drop of the heat exchanger;
- obtaining the heat exchanger outlet temperature according to the refrigerant flow, the heat exchange inlet temperature, the heat exchange of the heat exchange and the saturation temperature corresponding to the heat exchanger inlet pressure;
- obtaining the saturation temperature corresponding to the heat exchanger outlet pressure according to the heat exchanger outlet pressure.

In some embodiments, the calculation formula of the refrigerant pressure drop of the heat exchanger is as follows:

$$dp2=f3(m,Fs)=A3*m(c0+c1*Fs)$$

The calculation formula of the heat exchange of the heat exchanger is as follows:

$$Q2=f4(m,T1s,Fs,T0)=A4*M*[A5+A6*(T1s-T0)]*(c2+c3*Fs)$$

The calculation formula of the heat exchanger outlet pressure is as follows:

$$p2=p1-dp2$$

The calculation formula of the heat exchanger outlet temperature is as follows:

$$T2=T1-Q2/(m*B2*T1s)$$

The calculation formula of the saturation temperature corresponding to the heat exchanger outlet pressure is as follows:

$$T2s=b1/(\ln(p2)-b2)-b3$$

where dp2 is the refrigerant pressure drop of the compressor, f3(m, Fs) is a function related to the refrigerant flow m and the wind speed setting Fs, A3~A6 are parameters related to the structure of the heat exchanger, and c0~c3 are parameters related to the characteristics of the fan of the outdoor unit;

Q2 is the heat exchange of the heat exchanger, f4(m, T1s, Fs, TO) is a function related to the refrigerant flow m, the saturation temperature T1s corresponding to the heat exchanger inlet pressure, the wind speed setting Fs, and the outdoor environment temperature TO;

p2 is the heat exchanger outlet pressure;

T2 is the heat exchanger outlet temperature;

T2s is the saturation temperature corresponding to the heat exchanger outlet pressure.

As shown in FIG. 5, in some embodiments, step S303 further includes:

step S503, if the refrigerant at the outlet of the heat exchanger is in the supercooling state, then determining the refrigerant state at the outlet of the high-pressure liquid pipe according to the outdoor environment temperature, the operating parameters of the heat exchanger and the opening degree of the first electronic expansion valve.

In practice, if the refrigerant at the outlet of the heat exchanger is in the supercooling state, then it is possible to further determine the refrigerant state at the outlet of the high-pressure liquid pipe according to the outdoor environment temperature, the operating parameters of the heat exchanger and the opening degree of the first electronic expansion valve. In one embodiment, it is possible to calculate the high-pressure liquid pipe outlet temperature and a saturation temperature corresponding to the high-pressure liquid pipe outlet pressure according to the outdoor environment temperature, the refrigerant flow, the heat exchanger outlet pressure and outlet temperature, the saturation temperature corresponding to the heat exchanger outlet pressure and the opening degree of the first electronic expansion valve, and then determine the refrigerant state at the outlet of the high-pressure liquid pipe according to the high-pressure liquid pipe outlet temperature and the saturation temperature corresponding to the high-pressure liquid pipe outlet pressure.

Figure 8:
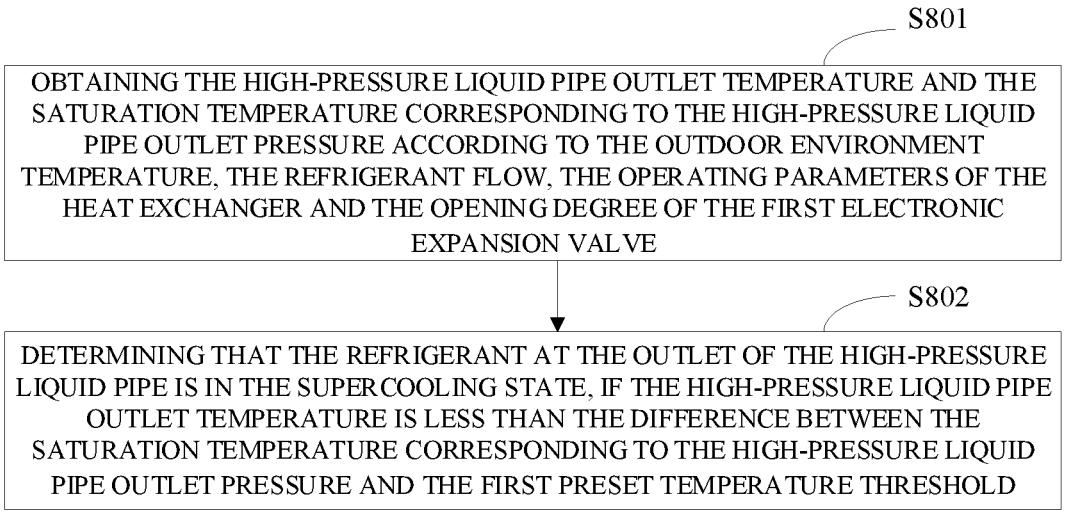
FIG. 8 is a schematic diagram of a sixth process of a refrigerant state detection method provided in the embodiments of this disclosure.

As shown in FIG. 8, in some embodiments, no matter whether the air conditioning system includes an economizer or not, step S503 includes the following steps S801 and S802:

At S801, obtain the high-pressure liquid pipe outlet temperature and the saturation temperature corresponding to the high-pressure liquid pipe outlet pressure according to the outdoor environment temperature, the refrigerant flow, the operating parameters of the heat exchanger and the opening degree of the first electronic expansion valve;

At S802, if the high-pressure liquid pipe outlet temperature is less than a difference between the saturation temperature corresponding to the high-pressure liquid pipe outlet pressure and the first preset temperature threshold, then determine that the refrigerant at the outlet of the high-pressure liquid pipe is in a supercooling state.

In practice, after the high-pressure liquid pipe outlet temperature and the saturation temperature corresponding to the high-pressure liquid pipe outlet pressure have been calculated, it is possible to compare the high-pressure liquid pipe outlet temperature with the difference between the saturation temperature corresponding to the high-pressure liquid pipe outlet pressure and the first preset temperature threshold, and then determine the refrigerant state at the outlet of the high-pressure liquid pipe according to the comparison result. For an air conditioning system without an economizer, it is possible to determine that the refrigerant at the outlet of the high-pressure liquid pipe is in a supercooling state or in a non-supercooling state according to the high-pressure liquid pipe outlet temperature and the saturation temperature corresponding to the high-pressure liquid pipe outlet pressure. For an air conditioning system with an economizer, it is only possible to determine the supercooling state of the refrigerant at the outlet of the high-pressure liquid pipe according to the high-pressure liquid pipe outlet temperature and the saturation temperature corresponding to the high-pressure liquid pipe outlet pressure, and the non-supercooling state should be determined according to an economizer inlet temperature and an economizer outlet temperature.

In some embodiments, step S801 includes the following steps:

- obtaining a refrigerant pressure drop of the high-pressure liquid pipe according to the refrigerant flow, the heat exchanger outlet temperature and the opening degree of the first electronic expansion valve;
- obtaining a heat leakage of the high-pressure liquid pipe according to the outdoor environment temperature, the refrigerant flow, and the heat exchanger outlet temperature;
- obtaining the high-pressure liquid pipe outlet pressure according to the heat exchanger outlet pressure and the refrigerant pressure drop of the high-pressure liquid pipe;
- obtaining the high-pressure liquid pipe outlet temperature according to the refrigerant flow, the heat exchanger outlet temperature, the saturation temperature corresponding to the heat exchanger outlet pressure and the heat leakage of the high-pressure liquid pipe;
- obtaining the saturation temperature corresponding to the high-pressure liquid pipe outlet pressure according to the high-pressure liquid pipe outlet pressure.

In some embodiments, the calculation formula of the refrigerant pressure drop of the high-pressure liquid pipe is as follows:

$$dp3=f5(m,T2,EXV)=[A7*m+m/(D0+D1*EXV)]*(B3*T2)$$

The calculation formula of the heat leakage of the high-pressure liquid pipe is as follows:

$$Q3=f6(m,T2,T0)=(T2-T0)*A8*m$$

The calculation formula of the high-pressure liquid pipe outlet pressure is as follows:

$$p3=p2-dp3$$

The calculation formula of the high-pressure liquid pipe outlet temperature is as follows:

$$T3=T2-Q3/(m*B2*T2s)$$

The calculation formula of the saturation temperature corresponding to the high-pressure liquid pipe outlet pressure is as follows:

$$T3s=b1/(\ln(p3)-b2)-b3$$

where dp3 is the refrigerant pressure drop of the high-pressure liquid pipe, f5(m, T2, EXV) is a function related to the refrigerant flow m, the heat exchanger outlet temperature T2 and the opening degree EXV of the first electronic expansion valve, A7~A8 are parameters related to the structure of the high-pressure liquid pipe, D0~D1 are parameters related to the characteristics of the first electronic expansion valve, and B3 is a refrigerant physical parameter related to the refrigerant type;

Q3 is the heat leakage of the high-pressure liquid pipe, and f6(m, T2, T0) is a function related to the refrigerant flow m, the heat exchanger outlet temperature T2 and the outdoor environment temperature T0;

p3 is the high-pressure liquid pipe outlet pressure;

T3 is the high-pressure liquid pipe outlet temperature;

T3s is the saturation temperature corresponding to the high-pressure liquid pipe outlet pressure.

The refrigerant state detection method provided in the embodiments corresponding to FIG. 8 may be applicable to refrigerant state detection for any air conditioning system.

Figure 9:
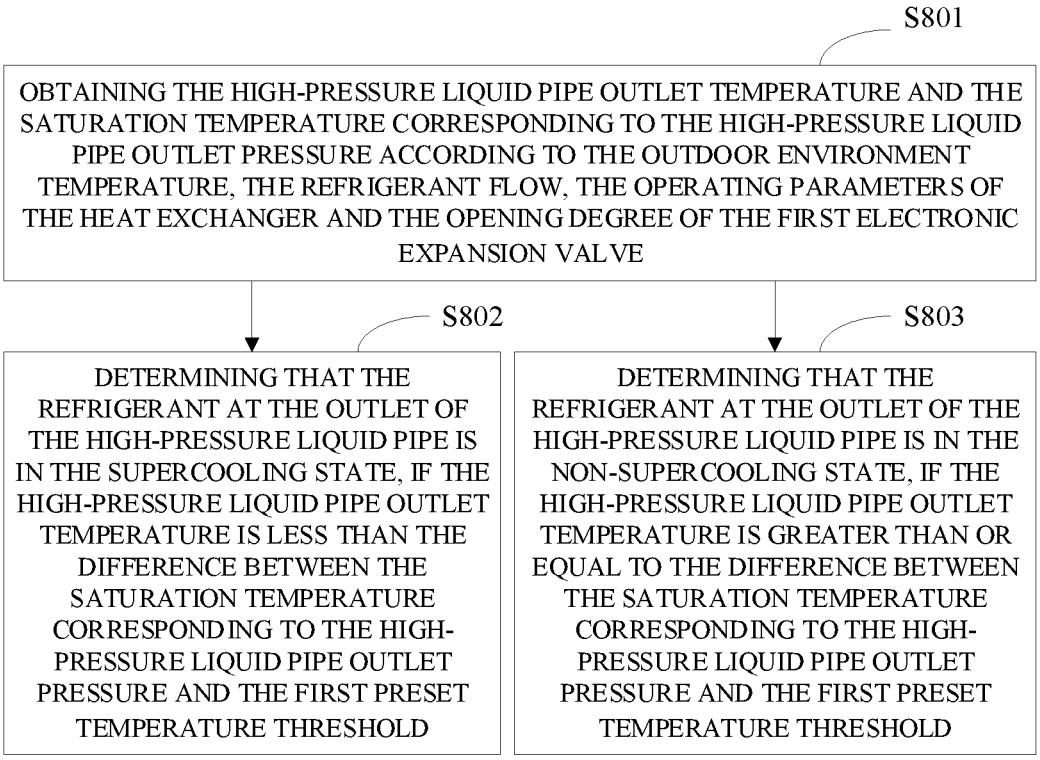
FIG. 9 is a schematic diagram of a seventh process of a refrigerant state detection method provided in the embodiments of this disclosure.

As shown in FIG. 9, in some embodiments, the air conditioning system does not include an economizer, and step S503 further includes the following step S803:

At step S803, if the high-pressure liquid pipe outlet temperature is greater than or equal to the difference between the saturation temperature corresponding to the high-pressure liquid pipe outlet pressure and the first preset temperature threshold, then determine that the refrigerant at the outlet of the high-pressure liquid pipe is in a non-supercooling state.

The refrigerant state detection method provided in the embodiments corresponding to FIG. 9 may be applicable to refrigerant state detection for an air conditioning system that does not include an economizer.

Figure 10:
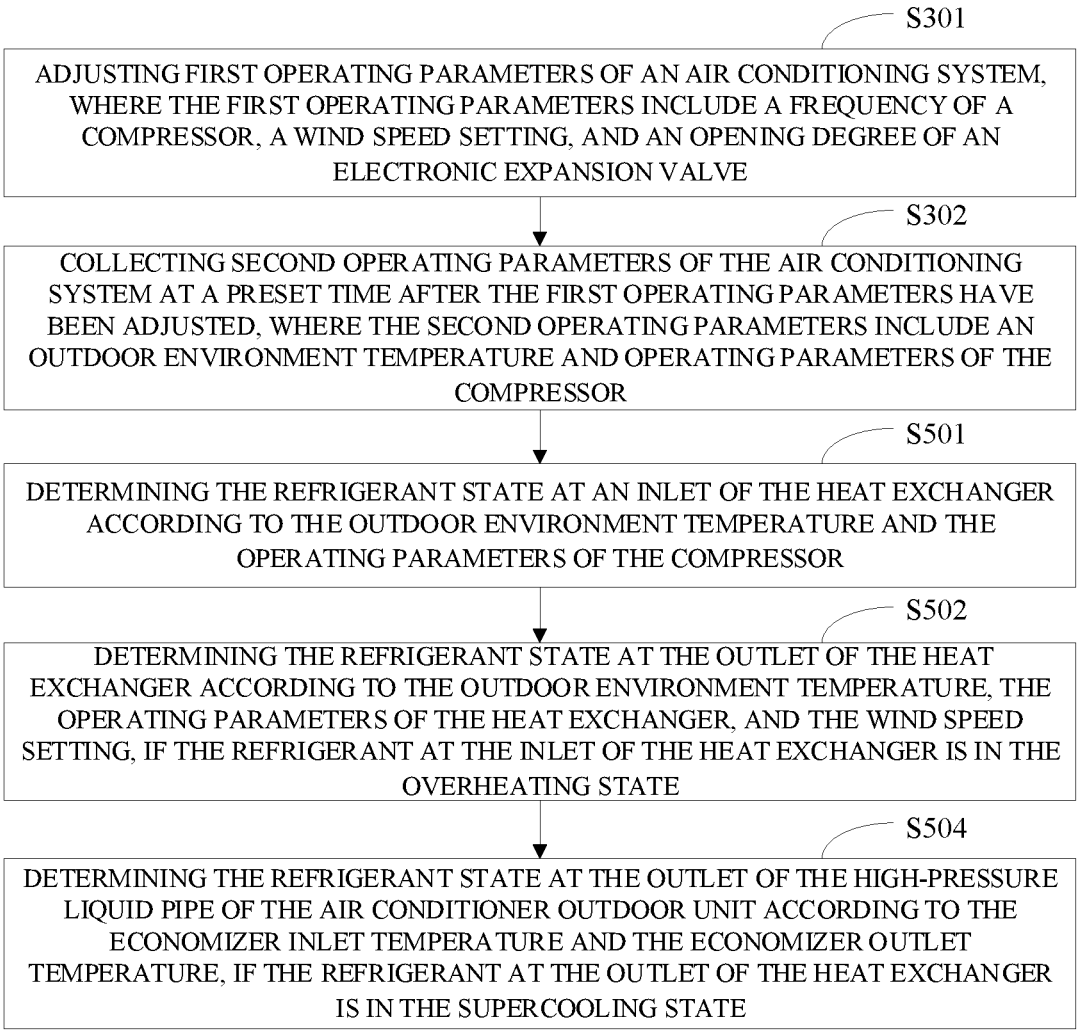
FIG. 10 is a schematic diagram of an eighth process of a refrigerant state detection method provided in the embodiments of this disclosure.

As shown in FIG. 10, in some embodiments, the air conditioning system includes an economizer, and step S303 further includes the following step S504:

At step S504, if the refrigerant at the outlet of the heat exchanger is in the supercooling state, then determine the refrigerant state at the outlet of the high-pressure liquid pipe of the air conditioner outdoor unit according to the economizer inlet temperature and the economizer outlet temperature.

In practice, if the refrigerant at the outlet of the heat exchanger is in the supercooling state, then it is possible to further determine the refrigerant state at the outlet of the high-pressure liquid pipe according to the economizer inlet temperature and the economizer outlet temperature.

In some embodiments, step S504 includes the following steps:

if a difference between the economizer outlet temperature and the economizer inlet temperature is less than a second preset temperature threshold, then determining that the refrigerant at the outlet of the high-pressure liquid pipe of the air conditioner outdoor unit is in a supercooling state;

if the difference between the economizer outlet temperature and the economizer inlet temperature is greater than or equal to the second preset temperature threshold, then determining that the refrigerant at the outlet of the high-pressure liquid pipe of the air conditioner outdoor unit is in a non-supercooling state.

In practice, after the economizer outlet temperature and the economizer inlet temperature have been collected, it is possible to compare the difference between the economizer outlet temperature and the economizer inlet temperature with the second preset temperature threshold, and then determine the refrigerant state at the outlet of the high-pressure liquid pipe according to the comparison result. The second preset temperature threshold may be customized by the user according to actual needs or use a value from the factory default settings, for example, any value between 1° C. and 5° C.

The refrigerant state detection method provided in the embodiments corresponding to FIG. 10 may be applicable to refrigerant state detection for an air conditioning system including an economizer.

The embodiments of this disclosure adjusts the frequency of the compressor, the wind speed setting and the opening degree of the electronic expansion valve of the air conditioning system, and collects the outdoor environment temperature and the operating parameters of the air conditioning system such as the frequency, the exhaust pressure, the return pressure, the return temperature and the exhaust temperature of the compressor, and the wind speed setting and the opening degree of the first electronic expansion valve of the outdoor unit, after the system operates stably, and the embodiments of the disclosure may accurately obtain the refrigerant state of the air conditioning system according to the operating parameters of the air conditioning system, and improve the safety and reliability of the air conditioning system during use.

It should be understood that the reference number of the steps in the above-mentioned embodiments does not define the execution sequence of each process, which should be determined by the function and internal logic thereof, and should not constitute any limitation on the implementation process of the embodiments of this disclosure.

The embodiments of the present disclosure further provides a refrigerant state detection apparatus applicable to an air conditioning system, and the refrigerant state detection device is used for executing the method steps in the above refrigerant state detection method embodiments. The refrigerant state detection apparatus may be a virtual appliance in the air conditioning system operated by a processor of the air conditioning system, or may be the air conditioning system itself.

Figure 11:
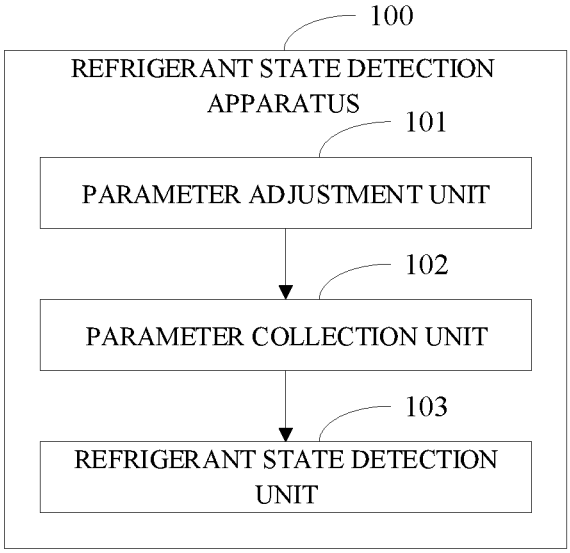
FIG. 11 is a schematic diagram of a structure of a refrigerant state detection apparatus provided in the embodiments of this disclosure.

As shown in FIG. 11, the refrigerant state detection apparatus 100 provided in the embodiments of this disclosure includes:

a parameter adjustment device 101 for adjusting first operating parameters of the air conditioning system, where the first operating parameters include a frequency of a compressor, a wind speed setting, and an opening degree of an electronic expansion valve of an air conditioner outdoor unit;

a parameter collection device 102 for collecting second operating parameters of the air conditioning system at a preset time after the first operating parameters have been adjusted, where the second operating parameters include an outdoor environment temperature and operating parameters of the compressor;

a refrigerant state detection device 103 for determining a refrigerant state of the air conditioning system according to the second operating parameters.

In some embodiments, the parameter adjustment device includes:

an instruction receiving subunit for entering a refrigerant state detection mode in respond to receiving of a power-on instruction or a refrigerant state detection instruction;

a parameter adjustment subunit for adjusting, in the refrigerant state detection mode, the frequency of the compressor to be a preset frequency, adjusting the wind speed setting of the air conditioner outdoor unit to be a preset wind speed setting, and adjust the opening degree of the electronic expansion valve of the air conditioner outdoor unit to be a preset opening degree.

In some embodiments, the refrigerant state detection device includes:

a refrigerant state detection subunit for determining a refrigerant state at an inlet of a heat exchanger according to the outdoor environment temperature and the operating parameters of the compressor;

a first determining subunit for determining a refrigerant state at an outlet of the heat exchanger according to the outdoor environment temperature, the operating parameters of the heat exchanger and the wind speed setting, if the refrigerant at the inlet of the heat exchanger is in an overheating state;

a second determining subunit for determining a refrigerant state at an outlet of a high-pressure liquid pipe according to the outdoor environment temperature, the operating parameters of the heat exchanger and the opening degree of the electronic expansion valve, if the refrigerant at the outlet of the heat exchanger is in a supercooling state; or a third determining subunit for determining the refrigerant state at the outlet of the high-pressure liquid pipe of the air conditioner outdoor unit according to the economizer inlet temperature and the economizer outlet temperature if the refrigerant at the outlet of the heat exchanger is in the supercooling state.

In practice, each unit in the refrigerant state detection apparatus may be a software program unit, or may be implemented by means of different logic circuits integrated in the processor, or may be implemented by means of distributed processors. A temperature obtaining unit may include a temperature sensor.

Figure 12:
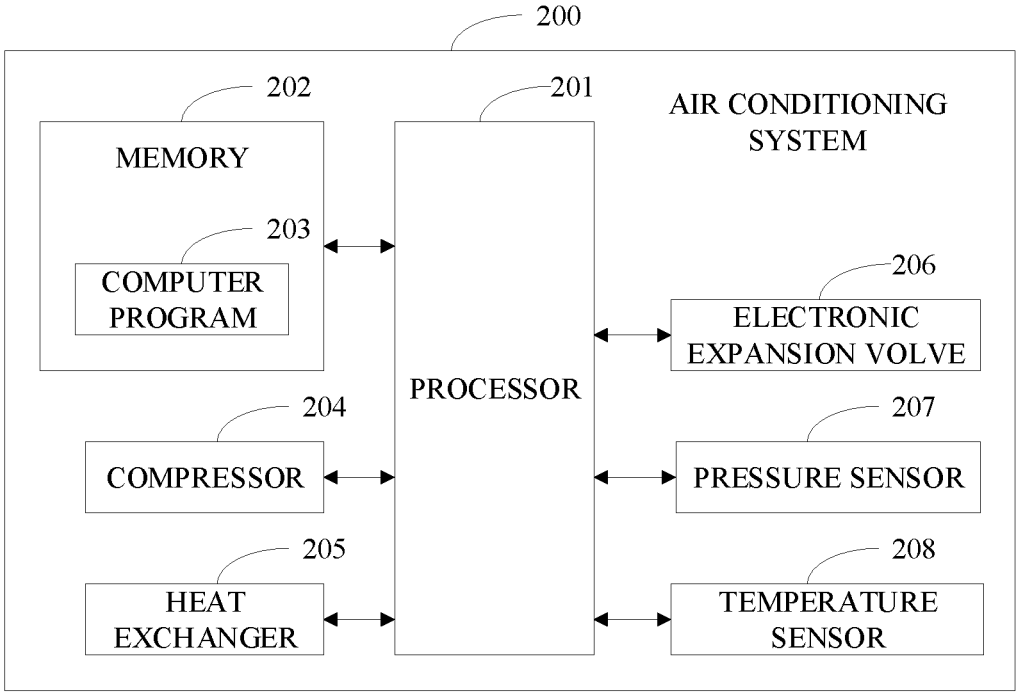
FIG. 12 is a schematic diagram of a third structure of an air conditioning system provided in the embodiments of this disclosure.

As shown in FIG. 12, the embodiments of this disclosure further provide an air conditioning system 200, which includes: at least one processor 201 (only one processor is shown in FIG. 12), a memory 202, and a computer program 203 stored in the memory 202 and executable on the at least one processor 201, and further includes a compressor 204, a heat exchanger 205, an electronic expansion valve 206, a pressure sensor 207 and a temperature sensor 208 connected to the at least one processor 201. When executing the computer program 203, the processor 201 implements the steps in each of the above-mentioned refrigerant state detection method embodiments.

In practice, the air conditioning system may include, but is not limited to, a processor, a memory, a compressor, a heat exchanger, an electronic expansion valve, a pressure sensor, and a temperature sensor, and may further include an oil separator, a four-way valve, a gas-liquid separator, an economizer, an evaporator, pipelines connecting the components, and the like. In some embodiments, FIG. 12 is merely an example of the air conditioning system, and does not constitute a limitation on the air conditioning system, which may more or fewer components than those shown in the figure, or a combination of some components or different components. For example, it may further include an input/output device, a network access device, and the like.

In practice, the processor may be a Central Processing Unit (CPU), or be other general purpose processor, a Digital Signal Processor (DSP), an Application Specific Integrated Circuit (ASIC), a Field-Programmable Gate Array (FPGA), or be other programmable logic device, discrete gate or transistor logic device, discrete hardware component, and etc. The general purpose processor may be a microprocessor, or the processor may also be any conventional processor.

In practice, the storage may be an internal storage unit of the air conditioning system in some embodiments, for example, a hard disk or a memory of the air conditioning system. The air conditioning system may also be an external storage device of the air conditioning system in some other embodiments, for example, a plug-in hard disk, a Smart Media Card (SMC), a Secure Digital (SD) card, a Flash Card, and the like, which is provided on the air conditioning system. Further, the storage may include both the internal storage unit and the external storage device, of the air conditioning system. The storage is configured to store an operating system, application programs, a Boot Loader, data and other programs such as a program code of a computer program. The storage may also be used to temporarily store data that has been or will be output.

It should be noted that content such as the execution processes and the information interactions between the devices/units described above are of the same concept as the method embodiments of the present disclosure, therefore reference may be made to the method embodiments for the specific functions and effects brought about. The details are not described herein again.

In some embodiments, the division of the above-mentioned functional units or modules is merely an example for illustration. In actual applications, the above-mentioned functions may be allocated to be performed by different functional units according to requirements, that is, the internal structure of the device may be divided into different functional units to complete all or part of the above-mentioned functions. The functional units in the embodiments may be integrated in one processing unit, or each unit may exist alone physically, or two or more units may be integrated in one unit. The above-mentioned integrated unit may be implemented in the form of hardware or in the form of software functional unit. In addition, the specific name of each functional unit is merely for the convenience of distinguishing each other and are not intended to limit the scope of protection of the present disclosure. For the specific operation processes of the units or modules in the above-mentioned system, reference may be made to the corresponding processes in the above-mentioned method embodiments. And the details will not be repeated here.

The embodiments of the present disclosure further provide a computer-readable storage medium storing a computer program, which, when executed by a processor, implements the steps in each of the foregoing refrigerant state detection method embodiments.

The embodiments of the present disclosure provide a computer program product, which, when running on an air conditioning system, enables the air conditioning system to implement the steps in each of the foregoing refrigerant state detection method embodiments.

When the integrated unit is implemented in the form of a software functional unit and is sold or used as an independent product, the integrated unit may be stored in a computer-readable storage medium. Based on this understanding, all or part of the processes of the method for implementing the above-mentioned embodiments of the present disclosure may also be implemented by instructing relevant hardware through a computer program. The computer program may be stored in a computer-readable storage medium, which may implement the steps of each of the above-mentioned method embodiments when executed by a processor. In one embodiment, the computer program includes computer program codes which may be in the form of source codes, object codes, executable files, or certain intermediate and the like. The computer-readable medium may include at least any primitive or device for carrying the computer program codes into the air conditioning system, a recording medium, computer memory, a Read-Only Memory (ROM), a Random Access Memory (RAM), electric carrier signals, telecommunication signals and software distribution media. For example, a USB flash drive, a portable hard disk, a magnetic disk, or an optical disk, and the like.

In the above embodiments, the description on each embodiment has its own emphasis, and for the part that are not described in detail or specified in some embodiments, one may refer to a related description on other embodiments.

The exemplary units and algorithm steps described in combination with the embodiments disclosed herein can be implemented with electronic hardware, or a combination of computer software and electronic hardware. Whether the functions are performed by hardware or software depends on the specific application and designed constraint conditions of the embodiments. Different methods may be used to implement the described functions for each specific application, but this should not be considered as beyond the scope of the present disclosure.

It should be understood that the disclosed apparatus and method in the embodiments provided in this disclosure may be implemented in other ways. For example, the apparatus embodiments described above are only illustrative. For example, the division of the units is only a logic functional division, and other division is possible in practical implementation. For example, multiple units or components may be combined or integrated into another system, or some features may be omitted, or not implemented. In addition, the intercoupling or direct coupling or communication connection shown or discussed may be through some interfaces, and the indirect coupling or communication connection between devices or units may be in electrical, mechanical or in other forms.

The unit described as a separate component may or may not be physically separated, and the part displayed as a unit may or may not be a physical unit, that is, it may be located in one place, or may also be distributed on multiple network units. Part or all of the units may be selected according to actual needs to achieve the purpose of the solutions of the embodiments.

The above-mentioned embodiments are merely intended for describing but not for limiting the embodiments of the present disclosure. Although the present disclosure is described in detail with reference to the above-mentioned embodiments, in each of the above-mentioned embodiments may still be modified, or some of the features may be equivalently replaced, while these modifications or replacements do not make the essence of the corresponding embodiments depart from the embodiments of the present disclosure, and should be included within the scope of the present disclosure.

What is claimed is:

1. A refrigerant state detection method, implemented by an air conditioning system, the method comprising:

adjusting first operating parameters of an air conditioning system, wherein the first operating parameters comprise a frequency of a compressor, a wind speed setting, and an opening degree of an electronic expansion valve;

collecting second operating parameters of the air conditioning system at a preset time after the first operating parameters have been adjusted, wherein the second operating parameters comprise an outdoor environment temperature and operating parameters of the compressor;

obtaining a refrigerant flow according to the frequency, an exhaust pressure, a return pressure and a return temperature of the compressor;

obtaining a pressure drop of an exhaust pipeline of the compressor according to the exhaust temperature and the exhaust pressure of the compressor and the refrigerant flow;

obtaining a heat leakage of the exhaust pipeline of the compressor according to the outdoor environment temperature, the exhaust temperature of the compressor, and the refrigerant flow;

obtaining the heat exchanger inlet pressure according to the exhaust pressure of the compressor and the pressure drop of the exhaust pipeline;

obtaining the heat exchanger inlet temperature according to the exhaust temperature of the compressor, the refrigerant flow, and the heat leakage of the exhaust pipeline;

obtaining the saturation temperature corresponding to the heat exchanger inlet pressure according to the heat exchanger inlet pressure; and determining that the refrigerant at the inlet of the heat exchanger is in an overheating state in case where the heat exchanger inlet temperature is greater than a sum of the saturation temperature corresponding to the heat exchanger inlet pressure and a first preset temperature threshold; and determining that the refrigerant at the inlet of the heat exchanger is in a non-overheating state and adjusting the first operating parameters in case where the heat exchanger inlet temperature is less than or equal to the sum of the saturation temperature corresponding to the heat exchanger inlet pressure and the first preset temperature threshold.

2. The refrigerant state detection method according to claim 1, wherein the second operating parameters further comprise the wind speed setting;

said determining a refrigerant state of the air conditioning system according to the second operating parameters further comprises:

determining a refrigerant state at an outlet of the heat exchanger according to the outdoor environment temperature, the refrigerant flow, operating parameters of the heat exchanger and the wind speed setting in case where the refrigerant at the inlet of the heat exchanger is in an overheating state.

3. The refrigerant state detection method according to claim 2, wherein said determining a refrigerant state at an outlet of the heat exchanger according to the outdoor environment temperature, the refrigerant flow, operating parameters of the heat exchanger and the wind speed setting comprises:

obtaining a heat exchanger outlet temperature and a saturation temperature corresponding to a heat exchanger outlet pressure according to the outdoor environment temperature, the refrigerant flow, the operating parameters of the heat exchanger and the wind speed setting; and determining that the refrigerant at the outlet of the heat exchanger is in a supercooling state in case where the heat exchanger outlet temperature is less than a difference between the saturation temperature corresponding to the heat exchanger outlet pressure and the first preset temperature threshold; and determining that the refrigerant at the outlet of the heat exchanger is in a non-supercooling state and adjusting the first operating parameters of the air conditioning system in case where the heat exchanger outlet temperature is greater than or equal to the difference between the saturation temperature corresponding to the heat exchanger outlet pressure and the first preset temperature threshold.

4. The refrigerant state detection method according to claim 3, wherein said obtaining a heat exchanger outlet temperature and a saturation temperature corresponding to a heat exchanger outlet pressure according to the outdoor environment temperature, the refrigerant flow, the operating parameters of the heat exchanger and the wind speed setting comprises:

obtaining a refrigerant pressure drop of the heat exchanger according to the wind speed setting and the refrigerant flow;

obtaining a heat exchange of the heat exchanger according to the outdoor environment temperature, the wind speed setting, the refrigerant flow, the heat exchanger inlet pressure and the heat exchanger inlet temperature;

obtaining the heat exchanger outlet pressure according to the heat exchanger inlet pressure and the refrigerant pressure drop of the heat exchanger;

obtaining the heat exchanger outlet temperature according to the refrigerant flow, the heat exchange inlet temperature, the heat exchange of the heat exchange and the saturation temperature corresponding to the heat exchanger inlet pressure; and obtaining the saturation temperature corresponding to the heat exchanger outlet pressure according to the heat exchanger outlet pressure.

5. The refrigerant state detection method according to claim 4, wherein the second operating parameters further comprise the opening degree of the electronic expansion valve;

said determining a refrigerant state of the air conditioning system according to the second operating parameters further comprises:

determining a refrigerant state at an outlet of a high-pressure liquid pipe according to the outdoor environment temperature, the operating parameters of the heat exchanger and the opening degree of the electronic expansion valve in case where the refrigerant at the outlet of the heat exchanger is in the supercooling state.

6. The refrigerant state detection method according to claim 5, wherein said determining a refrigerant state at an outlet of a high-pressure liquid pipe according to the outdoor environment temperature, the operating parameters of the heat exchanger and the opening degree of the electronic expansion valve comprises:

obtaining a high-pressure liquid pipe outlet temperature and a saturation temperature corresponding to a high-pressure liquid pipe outlet pressure according to the outdoor environment temperature, the refrigerant flow, the operating parameters of the heat exchanger and the opening degree of the first electronic expansion valve;

determining that the refrigerant at the outlet of the high-pressure liquid pipe is in the supercooling state in case where the high-pressure liquid pipe outlet temperature is less than a difference between the saturation temperature corresponding to the high-pressure liquid pipe outlet pressure and the first preset temperature threshold; and determining that the refrigerant at the outlet of the high-pressure liquid pipe is in a non-supercooling state in case where the high-pressure liquid pipe outlet temperature is greater than or equal to the difference between the saturation temperature corresponding to the high-pressure liquid pipe outlet pressure and the first preset temperature threshold.

7. An air conditioning system, comprising a memory, a processor and a computer program stored in the memory and executable on the processor, wherein the processor performs operations of a refrigerant state detection method when executing the computer program;

wherein the refrigerant state detection method comprises:

adjusting first operating parameters of an air conditioning system, wherein the first operating parameters comprise a frequency of a compressor, a wind speed setting, and an opening degree of an electronic expansion valve;

collecting second operating parameters of the air conditioning system at a preset time after the first operating parameters have been adjusted, wherein the second operating parameters comprise an outdoor environment temperature and operating parameters of the compressor;

obtaining a refrigerant flow according to the frequency, an exhaust pressure, a return pressure and a return temperature of the compressor;

obtaining a pressure drop of an exhaust pipeline of the compressor according to the exhaust temperature and the exhaust pressure of the compressor and the refrigerant flow;

obtaining a heat leakage of the exhaust pipeline of the compressor according to the outdoor environment temperature, the exhaust temperature of the compressor, and the refrigerant flow;

obtaining the heat exchanger inlet pressure according to the exhaust pressure of the compressor and the pressure drop of the exhaust pipeline;

obtaining the heat exchanger inlet temperature according to the exhaust temperature of the compressor, the refrigerant flow, and the heat leakage of the exhaust pipeline;

obtaining the saturation temperature corresponding to the heat exchanger inlet pressure according to the heat exchanger inlet pressure; and determining that the refrigerant at the inlet of the heat exchanger is in an overheating state in case where the heat exchanger inlet temperature is greater than a sum of the saturation temperature corresponding to the heat exchanger inlet pressure and a first preset temperature threshold; and determining that the refrigerant at the inlet of the heat exchanger is in a non-overheating state and adjusting the first operating parameters in case where the heat exchanger inlet temperature is less than or equal to the sum of the saturation temperature corresponding to the heat exchanger inlet pressure and the first preset temperature threshold.

8. The air conditioning system according to claim 7, wherein the second operating parameters further comprise the wind speed setting;

said determining a refrigerant state of the air conditioning system according to the second operating parameters further comprises:

determining a refrigerant state at an outlet of the heat exchanger according to the outdoor environment temperature, the refrigerant flow, operating parameters of the heat exchanger and the wind speed setting in case where the refrigerant at the inlet of the heat exchanger is in an overheating state.

9. The air conditioning system according to claim 8, wherein said determining a refrigerant state at an outlet of the heat exchanger according to the outdoor environment temperature, the refrigerant flow, operating parameters of the heat exchanger and the wind speed setting comprises:

obtaining a heat exchanger outlet temperature and a saturation temperature corresponding to a heat exchanger outlet pressure according to the outdoor environment temperature, the refrigerant flow, the operating parameters of the heat exchanger and the wind speed setting; and determining that the refrigerant at the outlet of the heat exchanger is in a supercooling state in case where the heat exchanger outlet temperature is less than a difference between the saturation temperature corresponding to the heat exchanger outlet pressure and the first preset temperature threshold; and determining that the refrigerant at the outlet of the heat exchanger is in a non-supercooling state and adjusting the first operating parameters of the air conditioning system in case where the heat exchanger outlet temperature is greater than or equal to the difference between the saturation temperature corresponding to the heat exchanger outlet pressure and the first preset temperature threshold.

10. The air conditioning system according to claim 9, wherein said obtaining a heat exchanger outlet temperature and a saturation temperature corresponding to a heat exchanger outlet pressure according to the outdoor environment temperature, the refrigerant flow, the operating parameters of the heat exchanger and the wind speed setting comprises:

obtaining a refrigerant pressure drop of the heat exchanger according to the wind speed setting and the refrigerant flow;

obtaining a heat exchange of the heat exchanger according to the outdoor environment temperature, the wind speed setting, the refrigerant flow, the heat exchanger inlet pressure and the heat exchanger inlet temperature;

obtaining the heat exchanger outlet pressure according to the heat exchanger inlet pressure and the refrigerant pressure drop of the heat exchanger;

obtaining the heat exchanger outlet temperature according to the refrigerant flow, the heat exchange inlet temperature, the heat exchange of the heat exchange and the saturation temperature corresponding to the heat exchanger inlet pressure; and obtaining the saturation temperature corresponding to the heat exchanger outlet pressure according to the heat exchanger outlet pressure.

11. The air conditioning system according to claim 10, wherein the second operating parameters further comprise the opening degree of the electronic expansion valve;

said determining a refrigerant state of the air conditioning system according to the second operating parameters further comprises:

determining a refrigerant state at an outlet of a high-pressure liquid pipe according to the outdoor environment temperature, the operating parameters of the heat exchanger and the opening degree of the electronic expansion valve in case where the refrigerant at the outlet of the heat exchanger is in the supercooling state.

12. The air conditioning system according to claim 11, wherein said determining a refrigerant state at an outlet of a high-pressure liquid pipe according to the outdoor environment temperature, the operating parameters of the heat exchanger and the opening degree of the electronic expansion valve comprises:

obtaining a high-pressure liquid pipe outlet temperature and a saturation temperature corresponding to a high-pressure liquid pipe outlet pressure according to the outdoor environment temperature, the refrigerant flow, the operating parameters of the heat exchanger and the opening degree of a first electronic expansion valve;

determining that the refrigerant at the outlet of the high-pressure liquid pipe is in the supercooling state in case where the high-pressure liquid pipe outlet temperature is less than a difference between the saturation temperature corresponding to the high-pressure liquid pipe outlet pressure and the first preset temperature threshold; and determining that the refrigerant at the outlet of the high-pressure liquid pipe is in a non-supercooling state in case where the high-pressure liquid pipe outlet temperature is greater than or equal to the difference between the saturation temperature corresponding to the high-pressure liquid pipe outlet pressure and the first preset temperature threshold.

13. A non-transitory computer-readable storage medium storing a computer program, that, when executed by a processor of an air conditioning system, causes the processor to perform operations of a refrigerant state detection method;

wherein the refrigerant state detection method comprises:

adjusting first operating parameters of an air conditioning system, wherein the first operating parameters comprise a frequency of a compressor, a wind speed setting, and an opening degree of an electronic expansion valve;

collecting second operating parameters of the air conditioning system at a preset time after the first operating parameters have been adjusted, wherein the second operating parameters comprise an outdoor environment temperature and operating parameters of the compressor;

obtaining a refrigerant flow according to the frequency, an exhaust pressure, a return pressure and a return temperature of the compressor;

obtaining a pressure drop of an exhaust pipeline of the compressor according to the exhaust temperature and the exhaust pressure of the compressor and the refrigerant flow;

obtaining a heat leakage of the exhaust pipeline of the compressor according to the outdoor environment temperature, the exhaust temperature of the compressor, and the refrigerant flow;

obtaining the heat exchanger inlet pressure according to the exhaust pressure of the compressor and the pressure drop of the exhaust pipeline;

obtaining the heat exchanger inlet temperature according to the exhaust temperature of the compressor, the refrigerant flow, and the heat leakage of the exhaust pipeline;

obtaining the saturation temperature corresponding to the heat exchanger inlet pressure according to the heat exchanger inlet pressure; and determining that the refrigerant at the inlet of the heat exchanger is in an overheating state in case where the heat exchanger inlet temperature is greater than a sum of the saturation temperature corresponding to the heat exchanger inlet pressure and a first preset temperature threshold; and determining that the refrigerant at the inlet of the heat exchanger is in a non-overheating state and adjusting the first operating parameters in case where the heat exchanger inlet temperature is less than or equal to the sum of the saturation temperature corresponding to the heat exchanger inlet pressure and the first preset temperature threshold.

* * * * *